US011223096B2

(12) United States Patent
Zhang et al.

(10) Patent No.: US 11,223,096 B2
(45) Date of Patent: Jan. 11, 2022

(54) DUAL-CHANNEL FILTER BASED ON DIELECTRIC RESONATOR

(71) Applicant: South China University of Technology, Guangzhou (CN)

(72) Inventors: Xiuyin Zhang, Guangzhou (CN); Jinxu Xu, Guangzhou (CN); Huiyang Li, Guangzhou (CN)

(73) Assignee: South China University of Technology, Guangzhou (CN)

( * ) Notice: Subject to any disclaimer, the term of this patent is extended or adjusted under 35 U.S.C. 154(b) by 365 days.

(21) Appl. No.: 16/343,204

(22) PCT Filed: Mar. 27, 2018

(86) PCT No.: PCT/CN2018/080592

§ 371 (c)(1),
(2) Date: Apr. 18, 2019

(87) PCT Pub. No.: WO2019/114149

PCT Pub. Date: Jun. 20, 2019

(65) Prior Publication Data

US 2021/0257708 A1 Aug. 19, 2021

(30) Foreign Application Priority Data

Dec. 14, 2017 (CN) ..... 201711339375.0

(51) Int. Cl.
*H01P 1/208* (2006.01)
*H01P 7/10* (2006.01)

(52) U.S. Cl.
CPC ..... *H01P 1/2086* (2013.01); *H01P 7/105* (2013.01)

(58) Field of Classification Search
CPC ..... H01P 1/2086; H01P 7/105
(Continued)

(56) References Cited

U.S. PATENT DOCUMENTS

2010/0013578 A1 1/2010 Memarian et al.
2018/0212299 A1* 7/2018 Numssen ..... H01P 7/105

FOREIGN PATENT DOCUMENTS

CN 103367846 A 10/2013
CN 204834808 U 12/2015
(Continued)

OTHER PUBLICATIONS

Quad-mode and dual-mode dielectric resonator filters; IEEE Transactions on Microwave Theory and Techniques, vol. 57, No. 12, Dec. 2009.

*Primary Examiner* — Robert J Pascal
*Assistant Examiner* — Jorge L Salazar, Jr.
(74) *Attorney, Agent, or Firm* — Fishman Stewart PLLC

(57) ABSTRACT

The present disclosure presents a dual-channel filter based on a dielectric resonator, which includes a metal cavity, a dielectric resonator, two tuning metal probes, and four feeding metal probes. The dielectric resonator is disposed at the center of the metal cavity. The four feeding metal probes are disposed around the metal cavity, and coupled to the dielectric resonator. The two tuning metal probes are connected to the metal cavity, and respectively located at a central position directly above and below the dielectric resonator. The dual-channel filter integrates two channel filters with good isolation between them, and has two input ports and two output ports.

7 Claims, 2 Drawing Sheets

(58) Field of Classification Search
USPC ..... 333/206, 207, 202, 203, 222, 223
See application file for complete search history.

(56) References Cited

FOREIGN PATENT DOCUMENTS

| | | | |
|---|---|---|---|
| CN | 105390780 | A | 3/2016 |
| CN | 207611848 | U | 7/2018 |

* cited by examiner

DUAL-CHANNEL FILTER BASED ON DIELECTRIC RESONATOR

CROSS-REFERENCE TO RELATED APPLICATIONS

This application claims priority to China Patent Application No. CN 201711339375.0 filed Dec. 14, 2017, and International Patent Application No. PCT/CN2018/080592 filed Mar. 27, 2018, both of which are hereby incorporated by reference in their entirety.

FIELD OF THE DISCLOSURE

The present disclosure relates to a filter applied to an RF front-end circuit, and more particularly to a dual-channel filter based on a dielectric resonator.

BACKGROUND OF THE DISCLOSURE

Filters are important components of RF front-end circuits in wireless communication systems, especially in fifth-generation (5G) massive multiple-input multiple-output (MIMO) systems, where a large number of filters are required. In order to reduce the size and construction costs of communication systems, many researchers have conducted research to design miniaturized filters.

The most common method for designing miniaturized filters is to use multimode resonators, folded quarter-wavelength resonators, or mixed left- and right-hand resonators in a planar printed circuit board (PCB) filter. In addition, the low temperature co-fired ceramic (LTCC) technology is also widely used, which can make the device highly integrated and thus effectively reduce the size. However, PCB and LTCC have the shortcomings of a low Q factor and a low power handling capability. To overcome these shortcomings, many researchers have used dielectric resonators and cavities with a high Q factor and a high power handling capability to design circuits. Among them, the most commonly used are the single-mode resonators in dielectric resonators and in the cavity, which can be used to achieve various filter topologies easily. However, since the resonators are used with single mode, more resonant cavities are required in one filter. Thus, there is a problem of large size. To reduce the size, multimode resonators are also used for the design of filters. For example, some researchers have constructed dual-mode, tri-mode or quad-mode dielectric resonators for the design of filters, duplexers, and so on. The use of multimode resonators can effectively reduce the number of resonant metal cavities, thereby reducing size, weight and cost.

At present, the method for size reduction of cavity or dielectric resonator filters is mainly focused on the design of one filter, such as reducing the size of resonators in one filter. It is very difficult to integrate multiple filters together because of interference between the filters. Therefore, multi-channel dielectric resonator filters or cavity filters have not been proposed yet.

OVERVIEW OF THE DISCLOSURE

In order to overcome the shortcomings and deficiencies of the prior art, the present disclosure provides a dual-channel filter based on a dielectric resonator.

The dual-channel filter of the present disclosure, functioning as two conventional filters, comprises only one quad-mode dielectric resonator, two input feeding lines and two output feeding lines in a single-cavity structure. By sharing one resonator and one metal cavity, the two filters can have their size reduced by more than 40% compared with the size of two conventional dual-mode filters. By properly arranging the position of the two input feeding lines and the two output feeding lines, and using the orthogonality between the modes of the quad-mode dielectric resonator, two of the modes can be excited to one channel filter, and the other two of the modes to the other channel filter, with almost no effect between the two channel filters, thus achieving good isolation between the two channel filters. There are three transmission zeros on the left and right sides of the passband, and thus a good filtering effect is achieved.

The present disclosure adopts at least the following technical solution:

A dual-channel filter based on a dielectric resonator is provided, comprising a metal cavity, a dielectric resonator, two tuning metal probes, and four feeding metal probes. The dielectric resonator is disposed at the center of the metal cavity. The four feeding metal probes, which are disposed around the metal cavity and parallel to the dielectric resonator, are coupled to the dielectric resonator. The two tuning metal probes, connected to the metal cavity, are respectively located at a central position directly above and below the dielectric resonator.

The four feeding metal probes are specifically a first feeding metal probe, a second feeding metal probe, a third feeding metal probe, and a fourth feeding metal probe. Each of the feeding metal probes is provided with a port, which is correspondingly defined as a first port, a second port, a third port, and a fourth port.

The first and second feeding metal probes are arranged face to face, and form one channel filter cooperated with the dielectric resonator.

The third and fourth feeding metal probes are arranged face to face, and form the other channel filter together with the dielectric resonator, thus achieving isolation between the two channel filters within the passband frequency range.

The line connecting the first and second feeding metal probes is perpendicular to the line connecting the third and fourth feeding metal probes.

The dual-channel filter has a symmetrical structure.

The metal cavity is a cylinder or a rectangular parallelepiped of equal length and width.

When the metal cavity is a rectangular parallelepiped of equal length and width, the first and second feeding metal probes are located at the opposite ends of one diagonal of the metal cavity, and the third and fourth feeding metal probes are located at the opposite ends of the other diagonal of the metal cavity.

With the height of the four feeding metal probes smaller than the height of the metal cavity, the first and third feeding metal probes extend downward from the top of the metal cavity along the wall of the metal cavity, and the second and fourth feeding metal probes extend upward from the bottom of the metal cavity along the inner wall of the metal cavity.

The dielectric constant of the dielectric resonator is set to a large dielectric constant of about 30 or more.

A support 8, made of foam or plastic, may also be included for securing the dielectric resonator to a central position of the metal cavity.

The dielectric resonator is designed to be cylindrical, but could be other shapes, and its ratio of diameter to height is used to control the resonant frequency such that two pairs of degenerate resonant modes, namely the $HEH_{11}$ mode and the $HEE_{11}$ mode, resonate at the same frequency, and that the two modes in each pair of the resonant modes are orthogonal to each other, thereby achieving a quad-mode resonator.

The present disclosure has at least the following beneficial effects:

(1) The present disclosure integrates two filters into a dual-channel filter having two inputs and two outputs, greatly reducing the size.

The present disclosure employs the design of a multimode dielectric resonator, and utilizes orthogonality between the modes to achieve isolation between the two channel filters.

BRIEF DESCRIPTION OF THE DRAWINGS

FIG. 2(*b*) shows parameter curves of S13, S14, S23 and S24 for simulation and test of a dual-channel filter based on a dielectric resonator of the present disclosure.

DETAILED DESCRIPTION OF THE EMBODIMENTS

The present disclosure will be further described below in detail with reference to the examples and drawings, but the embodiment of the present disclosure is not limited thereto.

EXAMPLES

Figure 1:
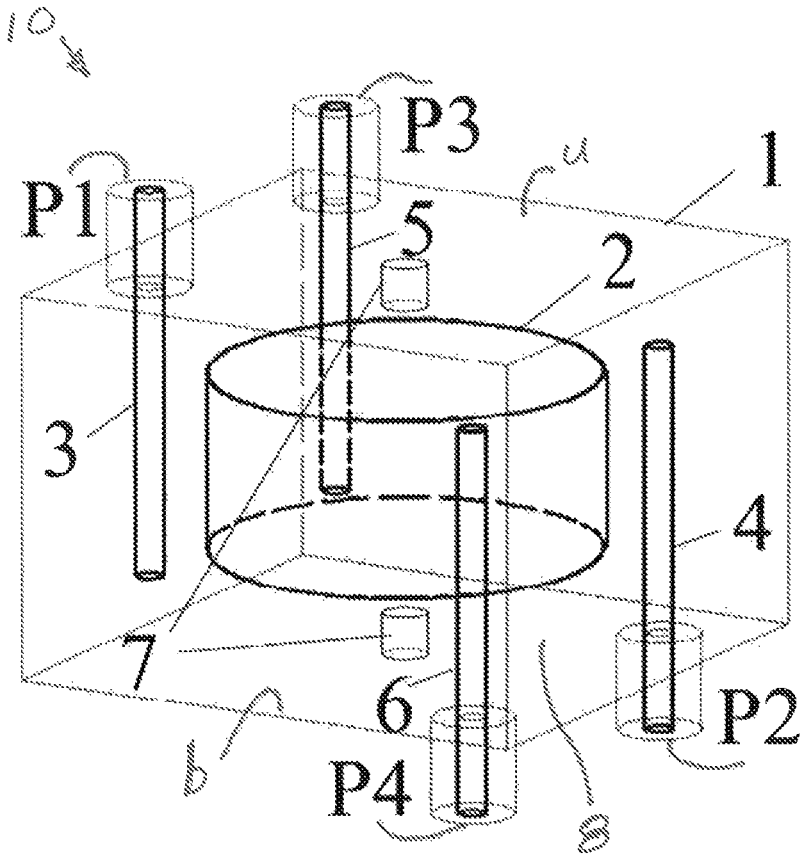
FIG. 1 is a schematic view of the structure of the present disclosure.

As shown in FIG. 1, a dual-channel filter 10 based on a dielectric resonator may comprise a metal cavity 1, a dielectric resonator 2, two tuning metal probes 7, and four feeding metal probes 3, 4, 5, 6. The dielectric resonator 2 is disposed at the center of the metal cavity 1, and has a dielectric constant set to a big value, generally 30 or more. It is supported by a plastic or foam 8 having a dielectric constant less than 10, so that it can be located at the center of the metal cavity.

The four feeding metal probes 3, 4, 5 and 6, disposed around the metal cavity 1, are parallel and close to the dielectric resonator 2 and thus coupled to the dielectric resonator 2. The two tuning metal probes 7, connected to the metal cavity, are respectively located at a central position directly above and below the dielectric resonator 2. The four feeding metal probes 3, 4, 5, and 6 are specifically a first feeding metal probe, a second feeding metal probe, a third feeding metal probe, and a fourth feeding metal probe. Each of the feeding metal probes is provided with a port (P), which is correspondingly defined as a first port P1, a second port P2, a third port P3, and a fourth port P4. Both the transmission path (TP1) from the first port P1 to the second port P2 and the transmission path (TP2) from the third port P3 to the fourth port P4 have filtering response. The first or second port and the third or fourth port are isolated from each other within the filter passband frequency range.

The first P1 and third P3 ports are mounted on the upper ends of the first and third feeding metal probes, while the second P2 and fourth P4 ports are mounted on the lower ends of the second and fourth feeding metal probes. The ports of the first and third feeding metal probes are disposed on the upper surface u of the metal cavity 1. Thus, the first and third feeding metal probes extend downward from the top of the metal cavity along the wall of the metal cavity. The second and fourth feeding metal probes extend upward from the bottom b of the metal cavity 1 along the wall of the metal cavity 1, with the height of the four feeding metal probes smaller than the height of the metal cavity 1.

The first and second feeding metal probes, disposed on two opposite faces of the metal cavity 1, are centrosymmetric with respect to the metal cavity 1 and, together with the dielectric resonator 2, form one channel filter of the dual-channel filter called the filter CF1. The third and fourth feeding metal probes, disposed on two opposite faces of the metal cavity, are centrosymmetric with respect to the metal cavity and, together with the dielectric resonator 2, form the other channel filter of the dual-channel filter 10 called the filter CF2. The line 11 connecting the first and second feeding metal probes is perpendicular to the line 12 connecting the third and fourth feeding metal probes, such that the first and second metal probes only excite one mode of each pair of the two pairs of orthogonal modes, while the third and fourth metal probes only excite the other mode of each pair of the two pairs of orthogonal modes, thereby achieving isolation between the filter CF1 and the filter CF2 in the passband frequency range.

The metal cavity 1 can be a cylinder or a rectangular parallelepiped of equal length and width.

When the metal cavity 1 is a cylinder, the four feeding metal probes 3, 4, 5, and 6 are disposed around the metal cavity 1, and the line connecting the first and second feeding metal probes is perpendicular to the line connecting the third and fourth feeding metal probes.

When the metal cavity 1 is a rectangular parallelepiped of equal length and width, the first and second feeding metal probes are disposed on one diagonal line of the rectangular parallelepiped, and the other two feeding metal probes are disposed on the other diagonal line.

The dielectric resonator 2 is designed to be cylindrical, and its ratio of diameter to height is used to control the resonant frequency such that the two pairs of degenerate resonant modes, namely the $HEH_{11}$ mode and the $HEE_{11}$ mode, resonate at the same frequency, and that the two modes in each pair of the resonant modes are orthogonal to each other, thereby achieving a quad-mode resonator.

Figure 2A:
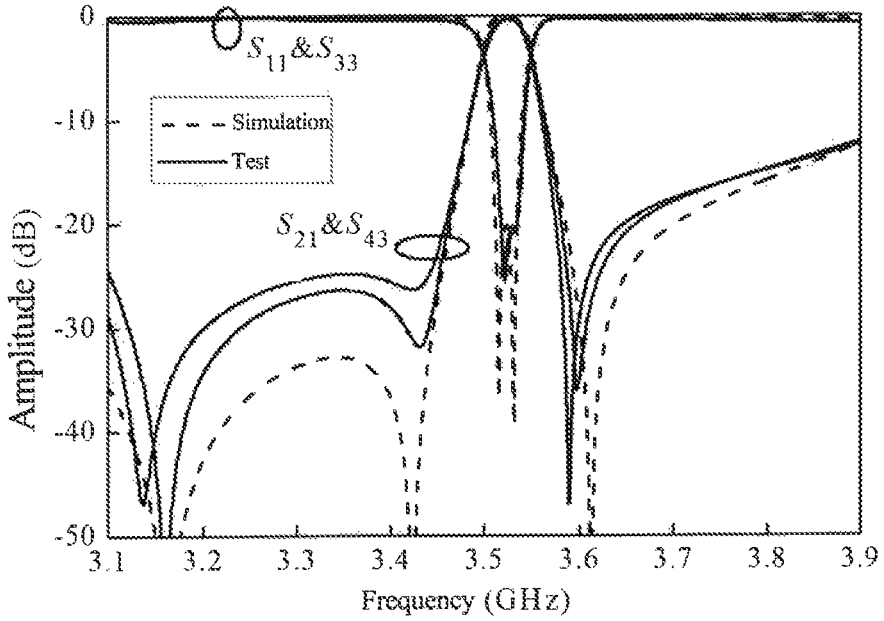
FIG. 2(*a*) shows parameter curves of S11, S21, S33 and S43 for simulation and test of a dual-channel filter based on a dielectric resonator of the present disclosure.
Figure 2B:
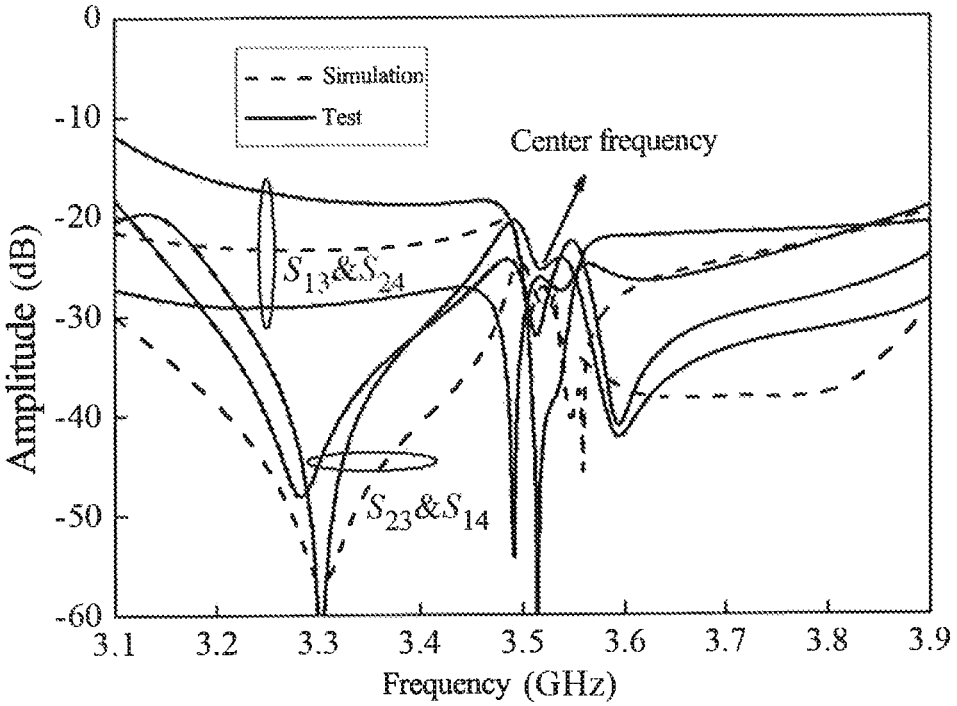

FIGS. 2(*a*) and 2(*b*) are diagrams showing experimental results of a dual-channel filter 10 based on a dielectric resonator 2 of the present disclosure. As can be seen from FIG. 2(*a*), the measured passband has a center frequency of about 3.525 GHz, a 3-dB bandwidth of 1.3%, an insertion loss of 0.32 dB at the center frequency, and three transmission zeros at 3.15 GHz, 3.43 GHz and 3.59 GHz, showing enhanced selectivity and out-of-band rejection. As can be seen from FIG. 2(*b*), the two channel filters CF1 and CF2 have an isolation of about 25.3 dB at the center frequency and an isolation greater than about 23 dB across the passband.

The dual-channel filter 10 of the present disclosure, having a symmetrical structure, utilizes orthogonality between the dielectric resonator modes to integrate the two filters into one device for the first time, such that a two-input two-output second-order dual-channel filter is designed in a single-cavity structure.

In summary, the present disclosure provides a dual-channel filter 10 based on a dielectric resonator 2, which has the advantages of small size, small insertion loss, good filtering effect, and high isolation between the two channel filters, suitable for a 5G massive MIMO antenna system.

The above-described examples are preferred embodiments of the present disclosure, but the embodiments of the present disclosure are not limited thereto, and any other alterations, modifications, substitutions, combinations and simplifications that are made without departing from the spirit and scope of the present disclosure are intended to be equivalents and are included in the scope of protection of the present disclosure.

What is claimed is:

1. A dual-channel filter comprising a metal cavity, a dielectric resonator, two tuning metal probes, and at least one feeding metal probe; the dielectric resonator is disposed at a center of the metal cavity; the at least one feeding metal probe is disposed around the metal cavity, and coupled to the dielectric resonator; the two tuning metal probes are connected to the metal cavity, and respectively located at a central position directly above and below the dielectric resonator;

wherein the at least one feeding metal probe includes a first feeding metal probe, a second feeding metal probe, a third feeding metal probe, and a fourth feeding metal probe;

wherein the metal cavity is a rectangular parallelepiped of equal length and width, the first and second feeding metal probes are located at opposite ends of one diagonal of the metal cavity, and the third and fourth feeding metal probes are located at the opposite ends of another diagonal of the metal cavity.

2. The dual-channel filter according to claim 1, wherein each of the feeding metal probes is provided with a port, which is correspondingly defined as a first port, a second port, a third port, and a fourth port; the first and second feeding metal probes are disposed on opposite sides of the metal cavity, and form a channel filter together with the dielectric resonator;

the third and fourth feeding metal probes are disposed on opposite sides of the metal cavity, and form channel filter together with the dielectric resonator; and a line connecting the first and second feeding metal probes is perpendicular to a line connecting the third and fourth feeding metal probes.

3. The dual-channel filter according to claim 2, wherein a height of the four feeding metal probes is smaller than a height of the metal cavity, the first and third feeding metal probes extend downward from a top of the metal cavity along a wall of the metal cavity, and the second and fourth feeding metal probes extend upward from a bottom of the metal cavity along the wall of the metal cavity.

4. The dual-channel filter according to claim 1, wherein the dielectric constant of the dielectric resonator is set to a dielectric constant of about 30 or more.

5. The dual-channel filter according to claim 1, wherein a support locates the dielectric resonator to a central position of the metal cavity.

6. The dual-channel filter according to claim 1, wherein the dielectric resonator is cylindrical, and its ratio of diameter to height is used to control the resonant frequency such that two pairs of degenerate resonant modes, namely the $HEH_{11}$ mode and the $HEE_{11}$ mode, resonate at the same frequency, and that the two modes in each pair of the resonant modes are orthogonal to each other, thereby achieving a quad-mode resonator.

7. A dual-channel filter comprising a metal cavity, a dielectric resonator, two tuning metal probes, and at least one feeding metal probe; the dielectric resonator is disposed at a center of the metal cavity; the at least one feeding metal probe is disposed around the metal cavity, and coupled to the dielectric resonator; the two tuning metal probes are connected to the metal cavity, and respectively located at a central position directly above and below the dielectric resonator;

wherein the at least one feeding metal probe includes a first feeding metal probe, a second feeding metal probe, a third feeding metal probe, and a fourth feeding metal probe;

wherein each of the feeding metal probes is provided with a port, which is correspondingly defined as a first port, a second port, a third port, and a fourth port; the first and second feeding metal probes are disposed on opposite sides of the metal cavity, and form a channel filter together with the dielectric resonator;

the third and fourth feeding metal probes are disposed on opposite sides of the metal cavity, and form channel filter together with the dielectric resonator; and a line connecting the first and second feeding metal probes is perpendicular to a line connecting the third and fourth feeding metal probes.

* * * * *